US008474660B2

(12) United States Patent
Frates

(10) Patent No.: US 8,474,660 B2
(45) Date of Patent: Jul. 2, 2013

(54) DISPENSING APPARATUS HAVING A PIVOT ACTUATOR

(75) Inventor: Paul S. Frates, Lawrenceville, GA (US)

(73) Assignee: Nordson Corporation, Westlake, OH (US)

( * ) Notice: Subject to any disclaimer, the term of this patent is extended or adjusted under 35 U.S.C. 154(b) by 1636 days.

(21) Appl. No.: 11/935,770

(22) Filed: Nov. 6, 2007

(65) Prior Publication Data

US 2008/0110940 A1 May 15, 2008

Related U.S. Application Data

(60) Provisional application No. 60/865,886, filed on Nov. 15, 2006.

(51) Int. Cl.
*B67D 7/80* (2010.01)

(52) U.S. Cl.
USPC ..... 222/146.5; 222/146.2; 222/334; 222/504; 222/509

(58) Field of Classification Search
USPC ..... 222/146.5, 505, 509, 146.2, 334, 222/559; 251/58, 62, 129.15, 231, 238
See application file for complete search history.

(56) References Cited

U.S. PATENT DOCUMENTS

| | | | | |
|---|---|---|---|---|
| 3,791,360 | A * | 2/1974 | Rieger | 123/568.26 |
| 5,407,101 | A | 4/1995 | Hubbard | |
| 5,535,919 | A * | 7/1996 | Ganzer et al. | 222/1 |
| 6,164,568 | A | 12/2000 | Muller et al. | |
| 6,210,141 | B1 | 4/2001 | Allen | |
| 6,354,463 | B1 | 3/2002 | Pahl | |
| 6,358,322 | B1 | 3/2002 | Pahl | |
| 6,619,566 | B2 | 9/2003 | Gressett, Jr. et al. | |
| 6,669,057 | B2 | 12/2003 | Saidman et al. | |
| 6,676,038 | B2 | 1/2004 | Gressett, Jr. et al. | |
| 7,156,251 | B2 | 1/2007 | Smith et al. | |
| 7,490,737 | B2 | 2/2009 | Cocciadiferro et al. | |
| 2005/0236438 | A1 | 10/2005 | Chastine et al. | |
| 2006/0097010 | A1 | 5/2006 | Riney | |

FOREIGN PATENT DOCUMENTS

| | | | |
|---|---|---|---|
| EP | 1308217 | A2 | 5/2003 |
| EP | 1588777 | A2 | 10/2005 |

OTHER PUBLICATIONS

U.S. Patent and Trademark Office, Office Action in U.S. Appl. No. 11/928,650, Feb. 7, 2011.
MAC Valves, Inc., MAC Series 33, Direct Solenoid and Solenoid Pilot Operated Valves, 8mm Valve, product catalog , undated, 5 pages.
Frates, U.S. Appl. No. 11/928,650, filed Oct. 30, 2007.
European Patent Office, International Search Report and Written Opinion in PCT Application No. PCT/US2007/084042, Mar. 7, 2008.

(Continued)

*Primary Examiner* — Kevin P Shaver
*Assistant Examiner* — Daniel R Shearer
(74) *Attorney, Agent, or Firm* — Wood, Herron & Evans, L.L.P.

(57) ABSTRACT

An apparatus for dispensing an adhesive generally comprises a dispensing module, a liquid supply component, and an actuating assembly. The actuating assembly includes a housing proximate the dispensing module and a three-way solenoid valve operatively coupled to the housing. A piston positioned within a piston chamber of the housing is configured to reciprocate along a piston axis when operated by pressurized air controlled by the solenoid valve. The piston is operatively coupled to a valve element within the dispensing module by a pivot arm.

13 Claims, 7 Drawing Sheets

OTHER PUBLICATIONS

European Patent Office, Invitation to Pay Additional Fees and Partial Search Report in PCT Application No. PCT/US2007/084042, Mar. 17, 2008.

U.S. Patent and Trademark Office, Office Action in U.S. Appl. No. 11/928,650, Sep. 13, 2010.

* cited by examiner

DISPENSING APPARATUS HAVING A PIVOT ACTUATOR

CROSS-REFERENCE TO RELATED APPLICATIONS

This application claims the benefit of U.S. Provisional Patent Application Ser. No. 60/865,886, filed Nov. 15, 2006 (pending) and entitled "Dispensing Apparatus Having a Pivot Actuator," the disclosure of which is fully incorporated by reference. This application is also related to co-pending U.S. patent application Ser. No. 11/928,650, filed Oct. 30, 2007 (pending) and entitled "Liquid Dispensing Apparatus Including an Attachment Member," the disclosure of which is also fully incorporated by reference.

TECHNICAL FIELD

The present invention relates generally to dispensing a heated liquid, and more specifically to an apparatus for dispensing hot melt adhesive and an actuating assembly for the same.

BACKGROUND

A typical apparatus for dispensing a heated liquid, such as hot melt adhesive, generally includes a dispensing module having a valve element that opens and closes a dispensing outlet. The valve element is positioned within a passage supplied with pressurized liquid and contacts a valve seat to prevent the adhesive from flowing to the outlet. To dispense the adhesive, an actuator, such as an electrically and/or pneumatically operated actuator, causes the valve element to move away from the valve seat and allows the adhesive to flow from the passage to the outlet. A biasing mechanism, such as a spring, or the same actuator may then cause the valve element to move back toward the valve seat to close the outlet.

Various arrangements have been developed for heated liquid dispensers. For example, U.S. application Ser. Nos. 10/975,227 ("the '227 application") and 10/907,514 ("the '514 application"), the disclosures of which are fully incorporated herein by reference, relate to dispensers in which a pivot arm operatively connects the valve element in a dispensing module to a piston in an adjacent housing. The piston is maintained in a first position within the housing by a spring or air pressure so that the pivot arm forces the valve element against a valve seat. A liquid supply component (typically referred to as a manifold) is coupled to the dispensing module on an opposite side from the housing and supplies heated liquid to a fluid passage around the valve element. Thus, when the piston member moves down, the pivot arm causes the valve element to move away from the valve seat so that the liquid within the fluid passage flows to an outlet.

Various areas for improvement exist, such as reducing complexity and increasing reliability of the actuating portion of the dispensing apparatus and reducing the size of the apparatus.

SUMMARY

An apparatus for dispensing a heated liquid, such as hot melt adhesive, is provided. The apparatus generally includes a pivot arm that serves as a pivot actuator and an actuating assembly having a three-way solenoid valve for controlling the operation of the pivot actuator.

To this end, one embodiment of an actuating assembly includes a housing having a piston chamber, a piston configured to reciprocate within the piston chamber along a piston axis, and an opening extending into the piston chamber. The opening is configured to receive a portion of a pivot arm so that the piston may be coupled to a first end of the pivot arm. This enables the piston to drive a valve element coupled to a second end of the pivot arm within a dispensing module. A three-way solenoid valve is operatively coupled to the housing and includes an inlet port for receiving pressurized air, a first outlet port communicating with the inlet port, a second outlet port selectively communicating with the inlet port, and an exhaust port selectively communicating with the second outlet port. The solenoid valve may be coupled to the housing along the piston axis.

The solenoid valve may further include a poppet movable between a first position and a second position. In one embodiment, pressurized air always passes from the inlet port to the first outlet port and selectively passes from the inlet port to the second outlet port. More specifically, when the poppet is in the first position, the first outlet port communicates with the inlet port and the second outlet port communicates with the exhaust port. When the poppet is in the second position, both the first and second outlet ports communicate with the inlet port. The piston further includes a piston head sealingly engaging the piston chamber, and the first and second outlet ports of the solenoid valve direct pressurized air at respective top and bottom surfaces of the piston head to operate the piston.

The actuating assembly may also include a thermal isolator positioned between the solenoid valve and housing. In such an embodiment, the thermal isolator includes a first passage extending from the first outlet port to a portion of the piston chamber communicating with the bottom surface of the piston head, a second passage extending from the second outlet port to a portion of the piston chamber communicating with the top surface of the piston head, and a third passage configured to direct pressurized air from the exhaust port to outside the thermal isolator. The thermal isolator may be formed from a thermally insulating material to reduce heat transfer from the housing to the solenoid valve.

The actuating assembly may be incorporated into a wide variety of liquid dispensing apparatuses. In one illustrative embodiment, an adhesive dispensing apparatus includes a dispensing module and the actuating assembly, with the housing of the actuating assembly being positioned proximate the dispensing module. The dispensing module includes a liquid inlet, a liquid passage in communication with the liquid inlet, an outlet in communication with the liquid passage, and a valve element movable within the liquid passage to selectively allow and prevent flow of the adhesive through the outlet. A pivot arm extending into the dispensing module operatively couples the piston of the actuating assembly to the valve element within the dispensing module.

In a further embodiment, the apparatus also includes a liquid supply component, such as a manifold or service block, coupled to the dispensing module and having a supply passage for directing adhesive to the liquid inlet. The housing of the actuating assembly may be at least partially received in the liquid supply component and may include a reduced diameter section defining a portion of the supply passage. To this end, adhesive may flow around the housing between the reduced diameter section and the liquid supply component.

In another illustrative embodiment, an adhesive dispensing apparatus includes a plurality of the dispensing modules coupled to a liquid supply component. A plurality of pivot arms each extend into a corresponding one of the dispensing modules and are each coupled to a valve element within the corresponding dispensing module. The apparatus also includes a plurality of actuating assemblies corresponding to the plurality of dispensing modules. To this end, each actuating assembly includes a housing at least partially received in the liquid supply component and a piston configured to reciprocate within a piston chamber of the housing, with the piston being operatively coupled to a corresponding one of the valve elements by one of the pivot arms. The actuating assemblies also include a three-way solenoid valve for operating the piston in the manner briefly discussed above and explained in further detail below.

BRIEF DESCRIPTION OF THE DRAWINGS

The accompanying drawings, which are incorporated in and constitute a part of this specification, illustrate exemplary embodiments of the invention.

DETAILED DESCRIPTION

Figure 1:
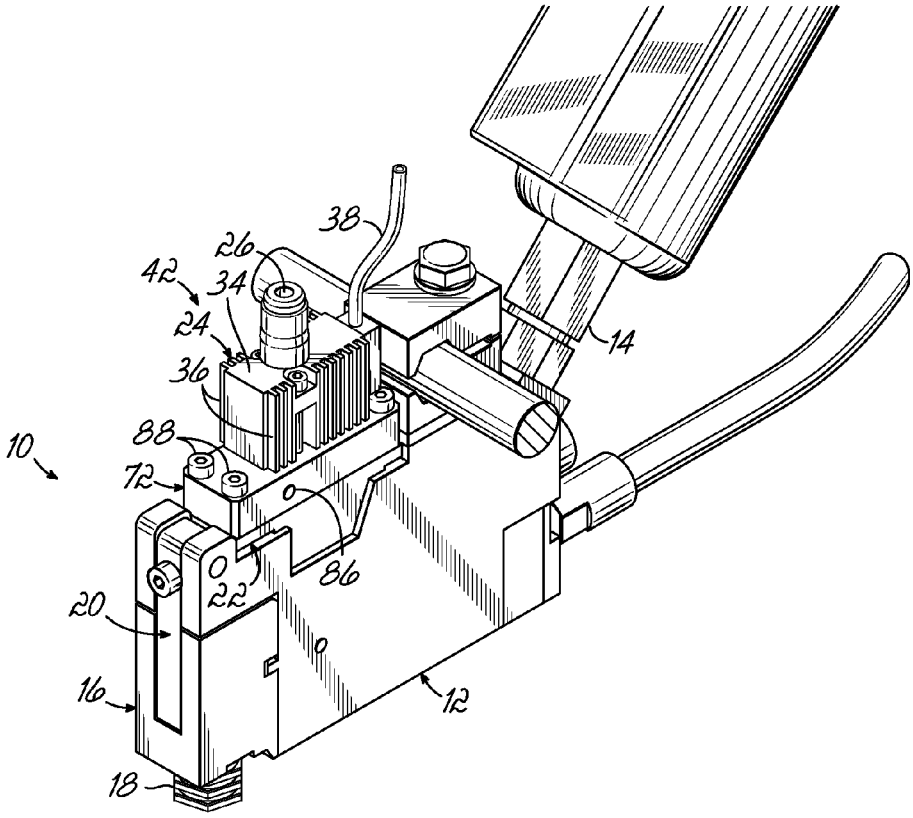
FIG. 1 is a perspective view of an apparatus for dispensing heated liquid, such as hot melt adhesive, according to one illustrative embodiment.
Figure 2:
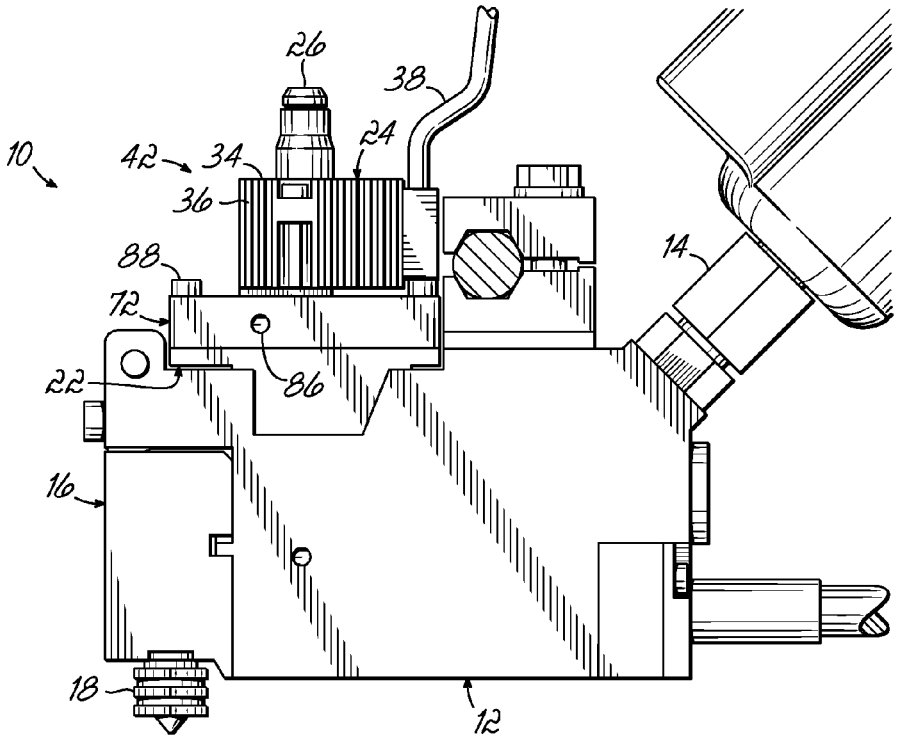
FIG. 2 is a side elevational view of the apparatus of FIG. 1.

FIGS. 1 and 2 show one illustrative embodiment of an apparatus 10 for dispensing a liquid, such as an adhesive. Furthermore, the liquid may be a heated liquid, such as hot melt adhesive. The apparatus 10 generally includes a liquid supply component 12 (sometimes referred to as a manifold or service block) adapted to receive adhesive from a hose 14 and a dispensing module 16 in fluid communication with the liquid supply component 12. The dispensing module 16 is adapted to dispense the liquid through a nozzle 18 and may be coupled to the liquid supply component 12 by an attachment member 20. For a more complete description of the attachment member 20, reference can be made to U.S. patent application Ser. No. 11/928,650. As discussed above, the disclosure of this co-pending application is fully incorporated herein by reference.

Figure 3:
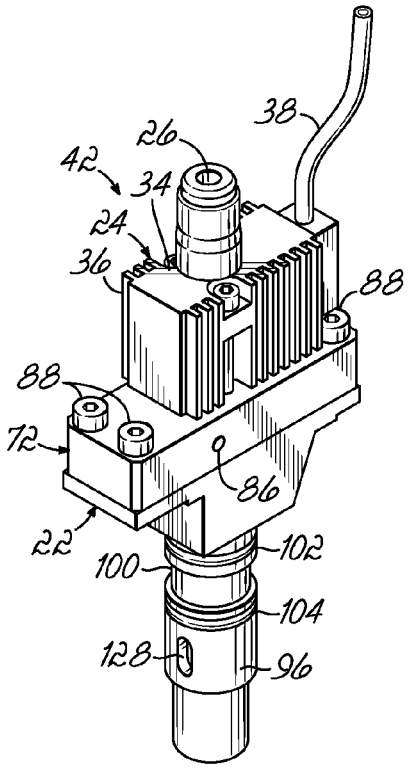
FIG. 3 is a perspective view of an actuating assembly incorporated into the apparatus of FIG. 1.
Figure 4:
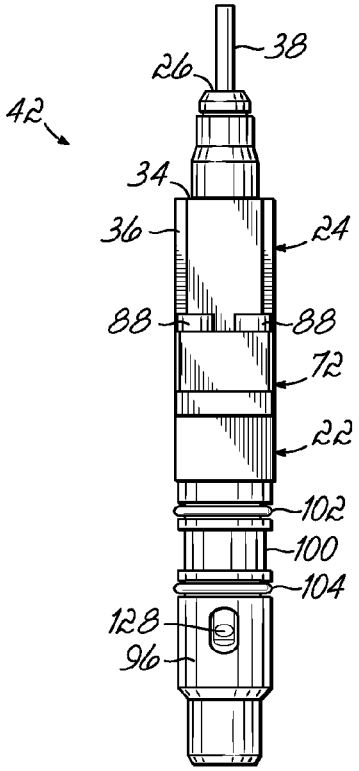
FIG. 4 is a front elevational view of the actuating assembly shown in FIG. 3.
Figure 6:
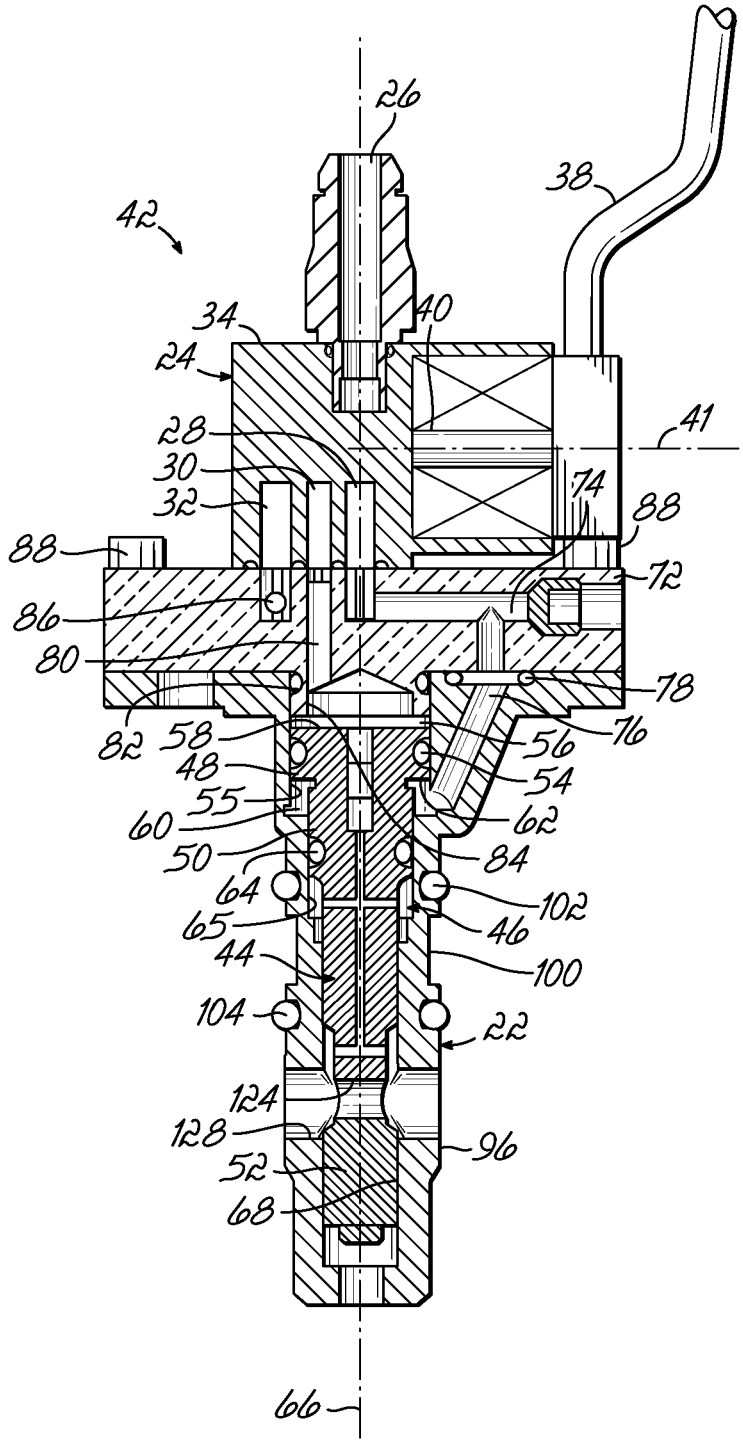
FIG. 6 is a cross-sectional side view of the actuating assembly shown FIG. 3.

In one embodiment, the apparatus 10 further includes a housing 22 proximate the dispensing module 16 and a solenoid valve 24 operatively coupled to the housing 22. The solenoid valve 24 and housing 22 may be secured together as a part of an actuating assembly 42 (FIG. 3) and positioned within a portion of the liquid supply component 12 as shown. Although the solenoid valve 24 and housing 22 are shown as being arranged in a generally linear and/or vertical manner substantially along a piston axis 66 (FIG. 6), other configurations are possible. For example, the housing 22 may alternatively be positioned on an opposite side of the dispensing module 16 than the liquid supply component 12 and the solenoid valve 24 may be operatively coupled to the housing 22 in a side-by-side arrangement.

With reference to FIGS. 3-6, the actuating assembly 42 is shown in further detail. The solenoid valve 24 may be a three-way, poppet-type valve having an inlet port 26, a first outlet port 28, a second outlet port 30, and an exhaust port 32. For example, the solenoid valve 24 may be a modified Series 33A valve distributed by Mac Valves, Inc., located in Wixam, Mich. The modifications may include a larger outer body 34 having fins 36 to help dissipate heat, a jacketed or reinforced cable 38 protecting electrical wires (not shown) that supply electrical current to the solenoid valve 24, and arranging the ports 26, 28, 30, 32 in the manner shown in FIG. 6. Because the internal components of the solenoid valve 24 operate in substantially the same manner as the Series 33A valves commercially available from Mac Valves, only a general overview of their operation is described below.

A constant source of pressurized fluid or gas, such as air, is supplied to the inlet port 26 and directed to the first outlet port 28. In one embodiment, the first outlet port 28 communicates with the inlet port 26 at all times. In this initial position, a poppet (not shown) within the body 34 allows the second outlet port 30 to communicate with the exhaust port 32. When the solenoid valve 24 receives electrical current from the wires within the cable 38, an electrical field is created that moves an armature (not shown) within the body 34 from a first position to a second position. The poppet is coupled to the armature by a push pin 40 and moves with the armature along an axis 41, which may be generally transverse to the piston axis 66. In the second position, the poppet allows communication between the inlet port 26 and the second outlet port 30. As a result, the inlet port 26 simultaneously directs pressurized air to both the first and second outlet ports 28, 30. The solenoid valve 24 is then de-energized and a spring (not shown) within the body 34 returns the armature and poppet to their initial positions. Pressurized air that was supplied to the second outlet port 30 may be released through the exhaust port 32 when the poppet returns to its initial position.

The housing 22 includes a piston chamber 46 and a piston 44 mounted for reciprocation within the piston chamber 46 along piston axis 66. More specifically, the housing 22 includes a piston 44 having a piston head 48, an intermediate portion 50, and a piston shaft 52. At least one O-ring or other seal 54 is provided around the piston head 48 to seal off a first portion 56 of piston chamber 46 communicating with a top surface 58 of piston head 48 from a second portion 60 of piston chamber 46 communicating with a bottom surface 62 of piston head 48. The intermediate portion 50 includes at least one O-ring or seal 64 as well so that the second portion 60 is sealed off from a remainder of the piston chamber 46. The seals 54, 64 may be hat seals that engage corresponding seal surfaces 55, 65 (FIG. 6) within the piston chamber 46. Providing this type of seal may help minimize seal friction that resists movement of the piston 44 within the piston chamber 46. As a result, less air pressure may be required to move the piston 44. Additionally, hat seals typically operate well at high temperatures and reduce wear so as to enable longer seal life.

The design of the piston chamber 46 may also contribute to longer seal life. In particular, the piston chamber 46 may further include a bearing surface 68 (FIG. 6) designed to guide the piston shaft 52 during its movement relative to the piston chamber 46. The bearing surface 68 may define a continuous through-bore through a portion of the housing 22. Additionally, the bearing surface 68 and first and second seal surfaces 55, 65 may be aligned along the piston axis 66. Such an arrangement helps reduce side loads on the seals 54, 64 and the piston head 48, which leads to a reduction in overall wear and increases the life of the components.

Figure 5:
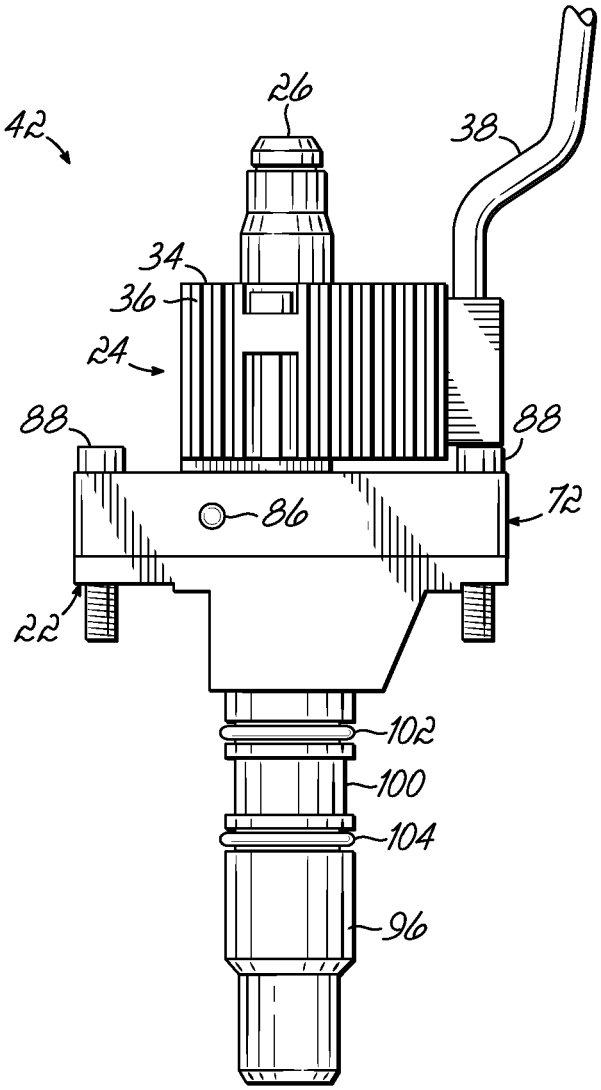
FIG. 5 is a side elevational view of the actuating assembly shown in FIG. 3.
Figure 5A:
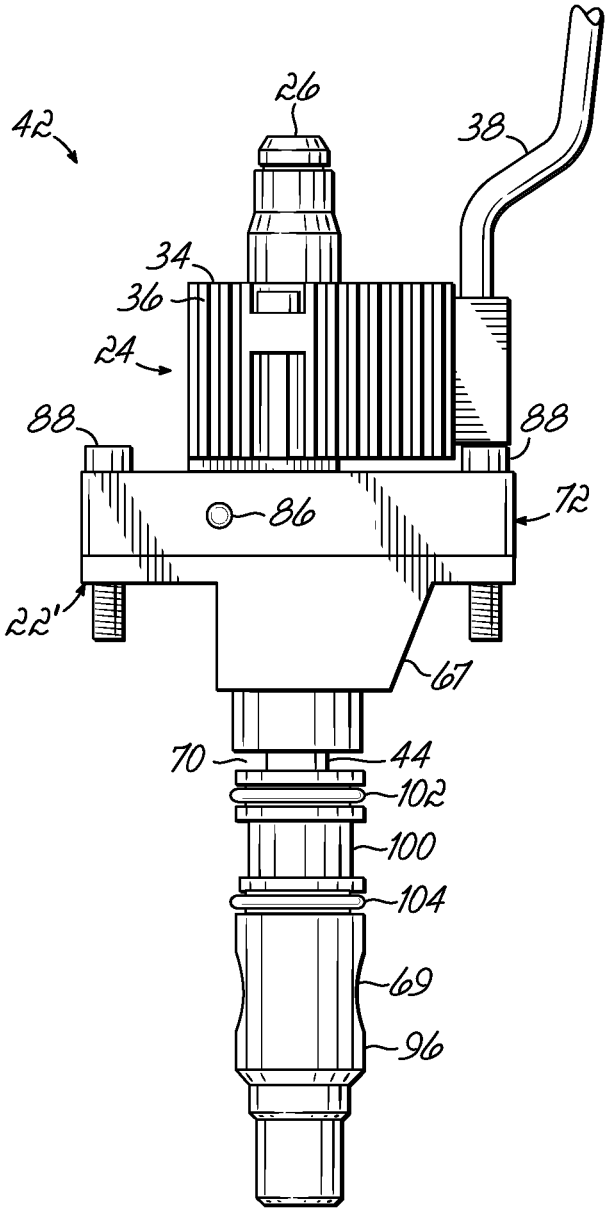
FIG. 5A is a side elevational view of an actuating assembly according to an alternative embodiment.

Although the housing 20 is shown as a single component, it will be appreciated that the actuating assembly 42 may alternatively include a housing constructed from two or more components. For example, FIG. 5A shows a two-piece housing 22' defined by a first housing component 67 and a second housing component 69. The first and second housing components 67, 69 may be received in the liquid supply component 12 (FIG. 1) so that a space or gap 70 is maintained therebetween.

Still referring to FIGS. 3-6, a thermal isolator 72 may be positioned between the solenoid valve 24 and housing 22. The thermal isolator 72 is formed from a thermally insulating material to reduce heat transfer from the housing 22 to the solenoid valve 24. In addition to this function, the thermal isolator 72 includes various passages for directing pressurized air from the ports of the solenoid valve 24 to the housing 22. Specifically, a first passage 74 is configured to extend from the first outlet port 28 of solenoid valve 24 to an inlet passage 76 of housing 22, which in turn communicates with the second portion 60 of piston chamber 46. The first passage 74 therefore allows pressurized air to be directed from the first outlet port 28 to the bottom surface 62 of piston head 48. An O-ring or other seal 78 may be provided around the first passage 74 at the interface between the thermal isolator 72 and housing 22 to prevent leakage.

A second passage 80 within the thermal isolator 72 is similarly configured to extend from the second outlet port 30 to the first portion 56 of piston chamber 46. An O-ring or other seal 82 may be provided between the piston chamber 46 and a lower portion 84 of thermal isolator 72 extending into the piston chamber 46 to seal off the first portion 56 of piston chamber 46. Thus, the second passage 80 is configured to direct pressurized air to the first portion 56 and at the top surface 58 of piston head 48. A third passage 86 in the thermal isolator 72 is configured to direct air from the exhaust port 32 of solenoid valve 24 to an area outside the thermal isolator 72.

The components of the actuating assembly 42 may be secured together using conventional fastening techniques. For example, bolts 88 may be used to secure the thermal isolator 72 to the housing 22. By arranging the components along the piston axis 66, the actuating assembly 42 may be designed to have a very small width. In one embodiment, the actuating assembly 42 is approximately 16 mm wide. Such a configuration reduces the amount of space occupied by the apparatus 10, which may be helpful when designing a larger system to include the apparatus 10.

Figure 7:
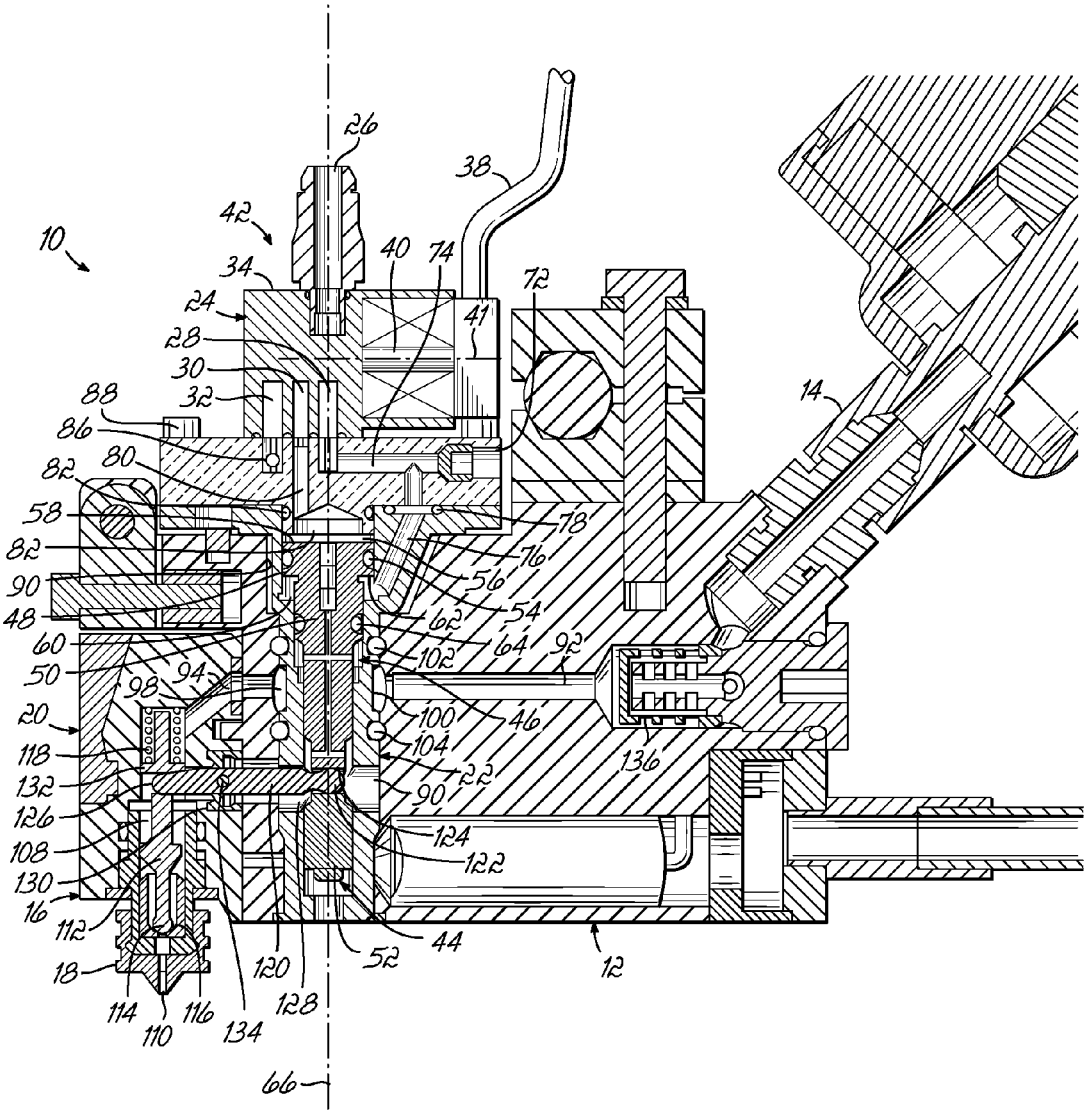
FIG. 7 is a cross-sectional side view of the apparatus of FIG. 1.

FIG. 7 shows the actuating assembly 42 incorporated into the apparatus 10. The housing 22 may be positioned within a corresponding slot, bore, or other recess 90 in the liquid supply component 12 between the dispensing module 16 and hose 14. To supply adhesive to the dispensing module 16, a supply passage 92 extends from the hose 14, around the housing 22, and to a liquid inlet 94 in the dispensing module 16. Thus, an outer surface 96 (FIGS. 3-6) of housing 22 and the recess 90 cooperate to define a portion 98 of supply passage 92. In one embodiment, the outer surface 96 includes a reduced diameter section 100 between two seals 102, 104 (e.g., O-rings) to help define the portion 98. Such an arrangement increases the size of the portion 98 and allows a greater amount of adhesive to flow around the housing 22 (increased flow capability).

The dispensing module 16 may be coupled to the liquid supply component 12 by the attachment member 20 or by conventional fasteners (not shown) extending through the dispensing module 16. In addition to the liquid inlet 94, the dispensing module 16 further includes a liquid passage 108 communicating with the liquid inlet 94 and an outlet 110 communicating with the liquid passage 108. A valve element 112 situated within the dispensing module 16 is adapted to move (e.g., reciprocate) within the liquid passage 108 to selectively prevent and allow the flow of adhesive through the outlet 110. More specifically, the valve element 112 includes a valve tip 114 configured to selectively engage a valve seat 116 within the dispensing module 16. The engagement between the valve tip 114 and the valve seat 116 cuts off fluid communication between the liquid passage 108 and outlet 110, thus preventing the adhesive from flowing out of the dispensing module 16. When the valve tip 114 is moved away from the valve seat 116, adhesive within the liquid passage 108 flows to the outlet 110 and exits the dispensing module 16. As described in greater detail below, pressurized air within the second portion 60 of piston chamber 46 and, if necessary, a spring or other biasing element 118 return the valve element 112 to its initial position against the valve seat 116 to once again cut off fluid communication between the liquid passage 108 and outlet 110.

The valve element 112 is operatively coupled to the piston 44 by a pivot arm 120. The pivot arm 120 includes a first end 122 that couples to the piston shaft 52. For example, in the embodiment shown in FIG. 7, the first end 122 is a ball that is configured to be received within a bore 124 machined or otherwise formed in the piston shaft 52. The bore 124 may have an elongate, oval-like cross-section so that it can receive the first end 122 even if there is some misalignment between the parts. A second end 126 of pivot arm 120 couples to the valve element 112 in a similar manner. Thus, the pivot arm 120 extends through both an opening 128 in housing 22 and a flexible seal 130 in dispensing module 16 so that the second end 126 is received in a through-bore 132 machined in the valve element 112. The pivot arm 120 pivots about a pin 134 coupled to the dispensing module 16 so that, as viewed in FIG. 7, downward motion of the piston 44 results in upward motion of the valve element 112. Conversely, upward motion of the piston 44 results in downward motion of the valve element 112. The flexible seal 130 prevents pressurized adhesive within the liquid passage 108 from leaking out of the dispensing module 16 at all times (i.e., when the pivot arm 120 is stationary and when the pivot arm 120 pivots about the pin 134).

In use, heated liquid, such as hot melt adhesive, is supplied to the liquid supply component 12 under controlled pressure by the hose 14. The adhesive is directed through a filter 136 (FIG. 7) and into the supply passage 92, where it flows around the housing 22 (via the portion 98 of supply passage 92) and to the liquid inlet 94 of dispensing module 16. The adhesive then travels into the liquid passage 108 to occupy the space around the valve element 112 and valve seat 116.

Additionally, air is supplied to the inlet port 26 of solenoid valve 24 under controlled pressure. In one embodiment, the pressurized air is always directed to the first outlet port 28, through the first passage 74 in thermal isolator 72, and into the second portion 60 of piston chamber 46 via the inlet passage 76. Thus, pressurized air occupies the second portion 60 and exerts pressure against the bottom surface 62 of piston head 48. This pressure maintains the piston 44 in an upward position so that the pivot arm 120 pushes downwardly on the valve element 112. The valve tip 114 engages the valve seat 116 in this initial position so that the adhesive within the liquid passage 108 is prevented from flowing to the outlet 110.

To dispense the adhesive, electric current supplied through the cable 38 energizes the solenoid valve 24. The current creates an electrical field that causes the poppet within the solenoid valve 24 to shift from a first position to a second position in which the second outlet port 30 is placed in communication with the inlet port 26. As a result, the inlet port 26 now directs pressurized air to both the first and second outlet ports 28, 30. The pressure of the air within the first passage 74 of the thermal isolator 72 and the second portion 60 of piston chamber 46 is maintained in these areas.

Meanwhile, as pressurized air supplied to the second outlet port 30 flows through the second passage 80 in thermal isolator 72 and into the first portion 56 of piston chamber 46, it exerts pressure against the top surface 58 of piston head 48. Although the pressure of the air in the first portion 56 is the same as the pressure of the air in the second portion 60, the top surface 58 has a greater amount of area exposed to the air than the bottom surface 62. Thus, a greater total force is applied to the piston head 48 by the pressurized air in the first portion 56 than by the pressurized air in the second portion 60. The result is a net downward force sufficient to overcome any seal friction and resistance to movement created by the spring 118 via the valve element 112 and pivot arm 120. This force drives the piston 44 downwardly in the piston chamber 46, causing the pivot arm 120 to pivot about the pin 134 so that the second end 126 moves the valve element 112 upward within the liquid passage 108 and away from the valve seat 116. The adhesive then flows from the liquid passage 108 to the outlet 110, where it is dispensed from the apparatus 10.

When current is no longer supplied to the solenoid valve 24, the poppet returns to its initial position so that the second outlet port 30 does not communicate with the inlet port 26 and instead communicates with the exhaust port 32. Pressurized air is still supplied to the second portion 60 of piston chamber 46 via the first outlet port 28 such that an upward force is maintained against the bottom surface 62 of the piston head 48. As a result, the piston 44 moves upwardly within the piston chamber 46 and the pressurized air previously supplied to the first portion 56 is exhausted through the exhaust port 32 and out of the third passage 86. The upward movement of the piston 44 causes the pivot arm 120 to drive the valve element 112 downward until the valve tip 114 engages the valve seat 116. The spring 118 also exerts forces against the valve element 112 to facilitate this movement. Advantageously, the spring 118 may serve as a back up to the pressurized air in the piston chamber 46. In other words, the spring 118 may help ensure that the valve element 112 returns to its initial position against the valve seat 116 in case pressurized air is not maintained in the second portion 60 or is not consistently supplied to the first outlet port 28. When the piston 44 returns to its upward, initial position, the valve element 112 once again prevents the adhesive from being dispensed from the outlet 110.

At this point current may be supplied to the solenoid valve 24 to begin a second dispensing cycle. The apparatus 10 may be operated at very rapid speeds because of its efficient design. For example, the apparatus 10 may dispense adhesive at speeds of approximates 10,000 cycles per minute. The apparatus 10 may dispense the adhesive as beads or in a stitched pattern.

Additionally, the use of a three-way solenoid valve to operate the apparatus 10 has many advantages. In particular, three-way solenoid valves are typically more forgiving of contaminants and cheaper in cost than four-way solenoids and other types of valves. The reliability of three-way solenoid valves helps ensure that the apparatus 10 is able to operate for many dispensing cycles without failure. For example, the solenoid valve 24 in the apparatus 10 may be capable of operating for 100 million total cycles under normal operating conditions.

Three-way solenoid valves also have relatively simple designs and can be designed to fit in small spaces. As noted above, the actuating assembly 42 incorporating the solenoid valve 24 may be approximately 16 mm wide. Because solenoid valves of this magnitude (small in size) typically have limited flow capacities, the volume of air moved through the valves must typically be kept to a minimum. Additionally, relatively small pistons, such as piston 44, can require relatively high pressures to operate (typically 70 psig). The mechanical advantage provided by the pivot arm ratio (the distance from the pin 134 to the first end 122 of pivot arm 120 divided by the distance from the pin 134 to the second end 126 of pivot arm 120) helps ensure that this pressure is sufficient to operate the valve element 112 within the dispensing module 16. Greater ratios require less air pressure to move the valve element 112 away from the valve seat 116.

Increasing the pivot arm ratio increases the distance the piston 44 must travel to move the valve element 112 a particular distance. As a result, the first and second portions 56, 60 of the piston chamber 46 become larger such that a greater volume of air is required to operate the piston 44. In one embodiment, the pivot arm ratio and the ratio between the exposed areas of the top and bottom surfaces 58, 62 of piston head 48 are optimized so that when operated by air supplied at 70 psig or less, the dispensing time of the apparatus 10 (i.e., the time that the valve element 112 is retracted from the valve seat 116 so liquid adhesive flows through the outlet 110) is approximately 2.5 milliseconds or less and the time between cycles (i.e., the time that the valve element 112 is in contact with the valve seat 116) is approximately 6 milliseconds or less. In such an embodiment the pivot arm ratio may be approximately 1.42—with the distance from the pin 134 to the first end 122 being approximately 0.475" and the distance from the pin 134 to the second end 126 being approximately 0.335"—and the ratio between exposed areas of the top and bottom surfaces 58, 62 may be approximately 2.54—with the diameter of the piston head 48 being approximately 0.56" and the diameter of the intermediate portion 50 being approximately 0.436". In another embodiment, the ratio between exposed areas of the top and bottom surfaces 58, 62 is approximately 2.28, with the diameter of the piston head 48 being approximately 0.5" and the diameter of the intermediate portion 50 being approximately 0.375".

Figure 8:
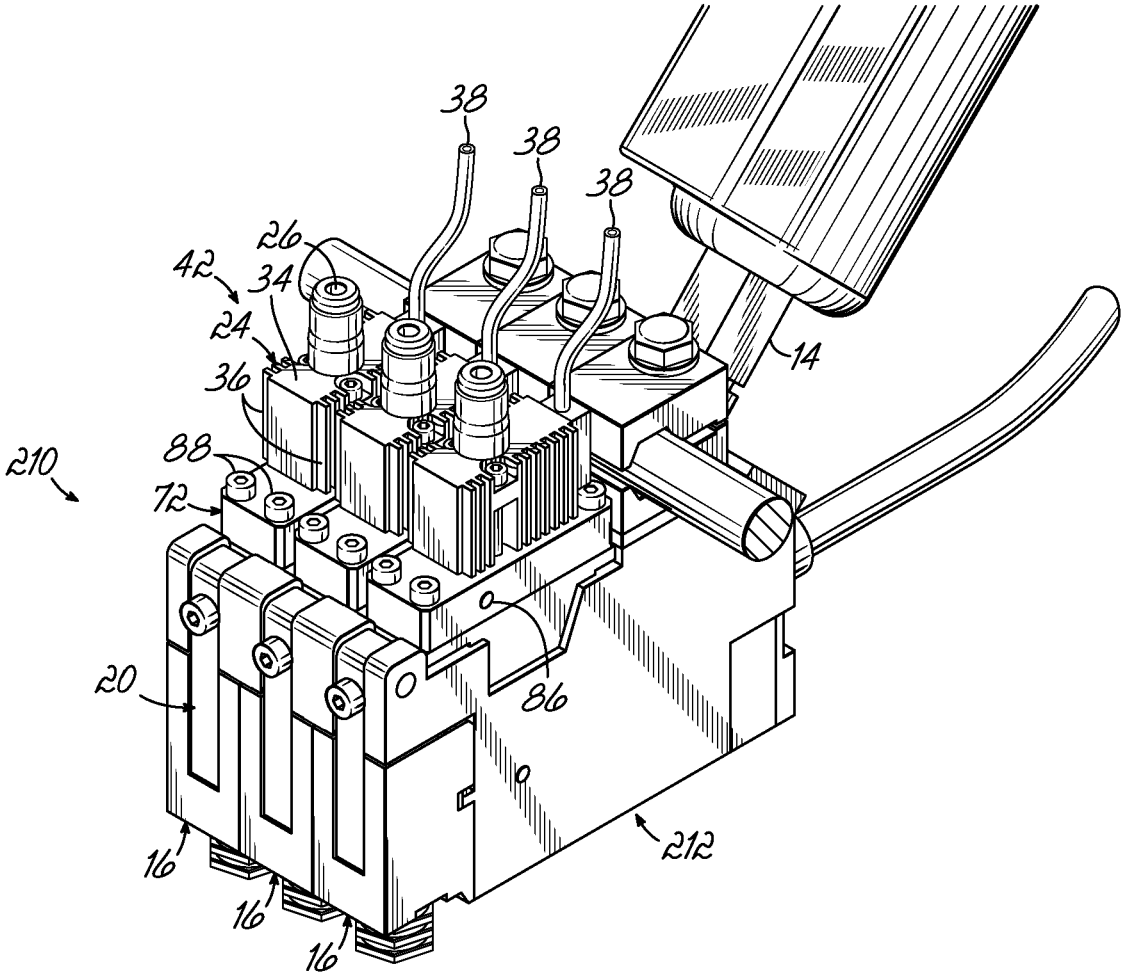
FIG. 8 is a perspective view of an apparatus for dispensing heated liquid according to an alternative embodiment.

FIG. 8 illustrates an adhesive dispensing apparatus 210 according to another embodiment, with like reference numbers being used to refer to like structure from the embodiment shown in FIGS. 1-7. The apparatus 210 includes a liquid supply component 212, such as a manifold or service block, that supplies hot melt adhesive to a plurality of the dispensing modules 16. To this end, the apparatus 210 also includes a plurality of actuating assemblies 42 each at least partially received in the liquid supply component 212. Each actuating assembly 42 may be received, for example, in a corresponding slot, bore, or other recess 90 (FIG. 7) provided in the liquid supply component 212. The piston in each actuating assembly 42 is operatively coupled to a valve element in a corresponding one of the dispensing modules 16 by a corresponding pivot arm (not shown). Because each actuating assembly 42 may be designed with a relatively small width, the liquid supply component 212 may receive a relatively large number of actuating assemblies 42 across its length.

Additionally, those skilled in the art will appreciate that the liquid supply component 212 may include a plurality of the supply passages 92 (FIG. 7) for directing adhesive to the plurality of dispensing modules 16. At least one of the housings 22 may include the reduced diameter section 100, which defines a portion of one of the supply passages 92 so that adhesive can flow around that particular housing between the reduced diameter section 100 and liquid supply component 212.

While the invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, because the first port 26 communicates with the first outlet port 28 at all times, either may serve as the inlet for pressurized air into the solenoid valve 24. The solenoid valve 24 therefore has two inlet options. Additionally, although the inlet port 26 and first outlet port 28 are discussed as being in constant communication, the inlet port 26 may alternatively selectively communicate with the first outlet port 28. The selective communication may be controlled by the poppet within solenoid valve 24 or by a separate valve (not shown). The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. An apparatus for dispensing an adhesive, comprising:

a dispensing module having a liquid inlet, a liquid passage in communication with said liquid inlet, an outlet in communication with said liquid passage to define a flow path from said liquid inlet to said outlet, a valve seat located in said flow path, and a valve element movable within said liquid passage into and out of engagement with said valve seat to selectively allow and prevent flow of the adhesive through said outlet;

a liquid supply component coupled to said dispensing module and having a supply passage for directing adhesive to said liquid inlet, said liquid supply component being constructed as a component independent from said dispensing module; and an actuating assembly, comprising:

a housing at least partially received in said liquid supply component, said housing constructed as a component independent from said dispensing module, said housing including a piston chamber and a piston configured to reciprocate within said piston chamber along a piston axis, said piston being operatively coupled to said valve element; and a three-way solenoid valve operatively coupled to said housing and configured to operate said piston, said solenoid valve having an inlet port for receiving pressurized air, a first outlet port continuously communicating with said inlet port, a second outlet port selectively communicating with said inlet port, and an exhaust port selectively communicating with said second outlet port.

2. The apparatus of claim 1 wherein said solenoid valve further includes a poppet movable between a first position and a second position, said first outlet port communicating with said inlet port when said poppet is in said first position and said second position, said second outlet port communicating with said inlet port when said poppet is in said second position, and said exhaust port communicating with said second outlet port when said poppet is in said first position.

3. The apparatus of claim 2 wherein said poppet of said solenoid valve is movable along an axis generally transverse to said piston axis.

4. The apparatus of claim 1 wherein said piston further includes a piston head sealingly engaging said piston chamber, said piston head having a top surface and a bottom surface, said first outlet port being configured to direct pressurized air to said bottom surface, and said solenoid valve being configured to selectively direct pressurized air through said second outlet port and to said top surface to operate said piston.

5. The apparatus of claim 4, further comprising:

a thermal isolator positioned between said solenoid valve and said housing, said thermal isolator being formed from a thermally insulating material to reduce heat transfer from said housing and said dispensing module to said solenoid valve.

6. The apparatus of claim 5 wherein said thermal isolator further includes a first passage extending from said first outlet port of said solenoid valve to a portion of said piston chamber communicating with said bottom surface of said piston head, a second passage extending from said second outlet port of said solenoid valve to a portion of said piston chamber communicating with said top surface of said piston head, and a third passage configured to direct pressurized air from said exhaust port of said solenoid valve to outside said thermal isolator.

7. The apparatus of claim 1 wherein said solenoid valve further includes an outer body having fins configured to dissipate heat transferred to said solenoid valve.

8. The apparatus of claim 1 wherein said piston within said housing comprises a piston head, an intermediate portion extending from said piston head, and a piston shaft extending from said intermediate portion, said piston head and said intermediate portion each having a seal adapted to sealingly engage said piston chamber, said piston chamber having a bearing surface adapted to guide said piston shaft as said piston moves within said piston chamber.

9. The apparatus of claim 1, further comprising:

a pivot arm extending into said dispensing module and coupled to said valve element, wherein said housing of said actuating assembly includes an opening configured to receive a portion of said pivot arm such that said piston is operatively coupled to said valve element by said pivot arm.

10. An apparatus for dispensing an adhesive, comprising:

a dispensing module having a liquid inlet, a liquid passage in communication with said liquid inlet, an outlet in communication with said liquid passage to define a flow path from said liquid inlet to said outlet, a valve seat located in said flow path, and a valve element movable within said liquid passage into and out of engagement with said valve seat to selectively allow and prevent flow of the adhesive through said outlet;

a liquid supply component coupled to said dispensing module and having a supply passage for directing adhesive to said liquid inlet, said liquid supply component being constructed as a component independent from said dispensing module; and an actuating assembly, comprising:

a housing at least partially received in said liquid supply component, said housing constructed as a component independent from said dispensing module, said housing including a piston chamber and a piston configured to reciprocate within said piston chamber along a piston axis, said piston being operatively coupled to said valve element; and a three-way solenoid valve operatively coupled to said housing along said piston axis and configured to operate said piston, said solenoid valve having an inlet port for receiving pressurized air, a first outlet port continuously communicating with said inlet port, a second outlet port selectively communicating with said inlet port, and an exhaust port selectively communicating with said second outlet port.

11. The apparatus of claim 10 wherein said liquid supply component defines a recess and said housing is at least partially received within said recess.

12. The apparatus of claim 11 wherein said housing including a reduced diameter section defining a portion of said supply passage so that adhesive can flow around said housing between said reduced diameter section and said liquid supply component.

13. The apparatus of claim 10, further comprising:

a pivot arm extending into said dispensing module and coupled to said valve element, wherein said housing of said actuating assembly includes an opening configured to receive a portion of said pivot arm such that said piston is operatively coupled to said valve element by said pivot arm.

* * * * *